US006839069B2

(12) United States Patent
Okuda

(10) Patent No.: US 6,839,069 B2
(45) Date of Patent: Jan. 4, 2005

(54) LIGHT EMISSION DISPLAY DRIVE METHOD AND DRIVE APPARATUS

(75) Inventor: Yoshiyuki Okuda, Saitama (JP)

(73) Assignee: Pioneer Corporation, Tokyo (JP)

( * ) Notice: Subject to any disclaimer, the term of this patent is extended or adjusted under 35 U.S.C. 154(b) by 135 days.

(21) Appl. No.: 09/988,712

(22) Filed: Nov. 20, 2001

(65) Prior Publication Data

US 2002/0060653 A1 May 23, 2002

(30) Foreign Application Priority Data

Nov. 22, 2000 (JP) ..... P. 2000-355780
Nov. 22, 2000 (JP) ..... P. 2000-355781

(51) Int. Cl.[7] ..... G09G 5/10

(52) U.S. Cl. ..... 345/690; 345/39; 345/41; 345/77; 345/78; 315/169.3

(58) Field of Search ..... 345/39, 41, 42, 345/74.1, 75.1, 75.2, 76–78, 204, 690–693; 315/169.1–169.4

(56) References Cited

U.S. PATENT DOCUMENTS 5,714,968 A * 2/1998 Ikeda ..... 345/77
5,953,002 A * 9/1999 Hirai et al. ..... 345/204
6,091,398 A * 7/2000 Shigeta ..... 345/204
6,388,678 B1 * 5/2002 Kasahara et al. ..... 345/690
6,465,966 B2 * 10/2002 Konuma ..... 315/169.1
2003/0095085 A1 * 5/2003 Abe ..... 345/74.1

* cited by examiner

*Primary Examiner*—Henry N. Tran
(74) *Attorney, Agent, or Firm*—Sughrue Mion, PLLC

(57) ABSTRACT

A light emission display drive apparatus used as a light emission display drive circuit includes an at least second-order ΔΣ modulator 3 for turning on/off a constant drive current or a constant drive voltage, thereby performing gradation control of each light emitting element. A pixel read section 2 reads the brightness value of each light emitting element in a predetermined period, the ΔΣ modulator 3 performs ΔΣ modulation in a predetermined period in response to the read brightness value, and an output change section 36 of the ΔΣ modulator performs operations of detecting unevenness of a list of output pulses of the ΔΣ modulation and dispersing the output pulses in the same light emitting element among light emitting elements, thereby performing multiple-step gradation control of the light emitting element.

54 Claims, 12 Drawing Sheets

LIGHT EMISSION DISPLAY DRIVE METHOD AND DRIVE APPARATUS

BACKGROUND OF THE INVENTION

1. Field of the Invention

This invention relates to a light emission display drive method and drive apparatus preferred for use for a multiple-step gradation display in a flat panel of organic EL, light emitting diode, plasma, etc.

2. Description of the Related Art

To change the light emission amount of each dot in the above-mentioned light emission display, the amount of charges injected within a drive time period of a target element may be changed and thus a method of changing a current value or a method of changing an on-time with the current value fixed can be used.

For convenience, the former is called a analog method and the latter is called a pulse method or time division method. The analog method has disadvantages that high-accuracy linearity is required to change the drive current in response to a brightness value, as the drive section becomes upsized and the drive current value changes with temperature, etc. On the other hand, in the pulse method, a constant current needs only to be output and thus the drive section is miniaturized and the temperature characteristic is also better.

With a light emission display drive apparatus using the pulse method, if an image signal is represented by k binary numbers, on/off control of a drive section is turned on/off in a period of one-$(2^k-1)$th of a frame period, and high-speed operation is required. The present applicant has proposed a light emission display drive circuit in Japanese Patent Application Nos. 2000-18330 and 2000-18331, wherein a drive section is driven, for example,at a drive rate lower than $(2^k-1)f_F$ (where $f_F$ is frame frequency) and the number of gradation steps corresponding to $2^K$ level can be provided equivalently in a reproducing band of a moving image, a frequency band of $f_F/2$ or less of so-called Nyquist band.

However, with the light emission display drive circuit described above, the possibility that unevenness of a list of output pulses may occur in a low-brightness area and a high-brightness area is left, directly resulting in occurrence of flicker noise, and the image quality is insufficient as gradation representation. The problem also occurs if the order of a used ΔΣ modulator is second order or higher.

SUMMARY OF THE INVENTION

An object of the invention is to provide a light emission display drive method and drive apparatus for a light emission display drive circuit, comprising an at least second-order ΔΣ modulator for turning on/off a constant drive current or a constant drive voltage, thereby performing gradation control of each light emitting element, wherein the brightness value of the light emitting element is read in a predetermined period, ΔΣ modulation is performed in a predetermined period in response to the read brightness value, and operation of dispersing unevenness of a list of output pulses that may occur in the operation of the ΔΣ modulator is performed, whereby occurrence of flicker noise can be lessened.

Another object of the invention is to provide a light emission display drive method and drive apparatus for use with a light emission display drive circuit for turning on/off a constant drive current or a constant drive voltage, thereby performing gradation control of each light emitting element, wherein the brightness value of the light emitting element is read in a predetermined period, ΔΣ modulation is performed in a predetermined period in response to the read brightness value, and as for occurrence of flicker noise as the output pulse period is prolonged in the low-brightness area and the high-brightness area, the phases of the output pulses of the ΔΣ modulators of nearby light emitting elements are dispersed, whereby occurrence of flicker noise in the whole light emission display can be lessened.

According to a first aspect of the invention, there is provided a light emission display drive method for a light emission display drive circuit, comprising an at least second-order ΔΣ modulator for turning on/off a constant drive current or a constant drive voltage, thereby performing gradation control of each light emitting element, the light emission display drive method comprising the steps of reading the brightness value of the light emitting element in a predetermined period, performing ΔΣ modulation in a predetermined period in response to the read brightness value, and performing operations of detecting unevenness of a list of output pulses of the ΔΣ modulation and dispersing the output pulses, thereby performing the gradation control of the light emitting element.

The evenness of a list of output pulses is improved in the low-brightness area and the high-brightness area of second-order or higher ΔΣ modulator and consequently, flicker noise is decreased and a light emission display drive method sufficient in image quality as gradation representation of light emitting elements can be provided.

According to the invention relating to the first aspect, there is provided a light emission display drive apparatus comprising a read section for reading the brightness value of each light emitting element in a predetermined period, and an at least second-order ΔΣ modulator for operating in a predetermined period in response to the read brightness value, characterized in that the ΔΣ modulator includes an arithmetic operation section for detecting unevenness of a list of output pulses and dispersing the output pulses.

According to the described configuration, the evenness of a list of output pulses is improved in the low-brightness area and the high-brightness area of second-order or higher ΔΣ modulator and consequently, flicker noise is decreased and a light emission display drive apparatus sufficient in image quality as gradation representation of light emitting elements can be provided.

According to the first aspect of the invention, the at least second-order ΔΣ modulator comprises a first integration section including a first addition section and a first delay section for delaying output of the first addition section a predetermined time, a second integration section including a second addition section connected to the first integration section and a second delay section for delaying output of the second addition section a predetermined time, a comparison and determination section for comparing an output value of the second integration section with a predetermined value for determination, a detection section for detecting unevenness of a list of output pulses based on the value of the second integration section, and a numeric change section for adding change to the value of the first or second integration section in response to the result of the detection section.

According to the first aspect of the invention, the detection section detects output of the second addition section exceeding one numeric range and the numeric change section adds such numeric change of bringing the output value of the second addition section close to the center value by a predetermined value only if the detection section detects output of the second addition section exceeding the numeric ranges According to the described configuration, the comparison and determination section monitors the value of the second integration section and if the value of the second integration section exceeds one range, it is determined that unevenness occurred in the output pulses, and such numeric change of correcting the unevenness is added to the second integration section, whereby a light emission display drive apparatus with flicker noise decreased can be provided.

According to a second aspect of the invention, there is provided a light emission display drive method for use with a light emission display drive circuit comprising a ΔΣ modulator for turning on/off a constant drive current or a constant drive voltage, thereby performing gradation control of each light emitting element, the light emission display drive method comprising the steps of reading the brightness value of the light emitting element in a predetermined period, performing ΔΣ modulation in a predetermined period in response to the read brightness value, and dispersing the phases of the output pulses of the ΔΣ modulation between the nearby light emitting elements among the light emitting elements, thereby performing the gradation control of the light emitting element.

The phases of the output pulses between the nearby light emitting elements in the low-brightness area and the high-brightness area of the ΔΣ modulators are dispersed and consequently flicker noise in the whole light emission display is decreased and a light emission display drive method sufficient in image quality as gradation representation of light emitting elements can be provided.

According to the invention relating to the second aspect, there is provided a light emission display drive apparatus comprising a read section for reading the brightness value of each light emitting element in a predetermined period, and a ΔΣ modulator for operating in a predetermined period in response to the read brightness value, characterized in that the ΔΣ modulator disperses the phases of the output pulses of ΔΣ modulation between the nearby light emitting elements among the light emitting elements.

The phases of the output pulses between the nearby light emitting elements in the low-brightness area and the high-brightness area of the ΔΣ modulators are dispersed and consequently flicker noise in the whole light emission display is decreased, so that a light emission display drive apparatus sufficient in image quality as gradation representation of light emitting elements can be provided.

According to the second aspect of the invention, the ΔΣ modulator comprises a detection section for detecting a phase difference of output pulses of the ΔΣ modulation between the nearby light emitting elements among the light emitting elements, and a numeric change section operating so as to disperse the phases of the output pulses of the ΔΣ modulator in the nearby light emitting elements based on the result of the detection section.

According to the configuration, if output pulse phase approach between the nearby light emitting elements occurs in the low-brightness area and the high-brightness area of the ΔΣ modulators, the mutual phases can be dispersed and consequently flicker noise in the whole light emission display is decreased, so that a light emission display drive apparatus sufficient in image quality as gradation representation of light emitting elements can be provided.

According to the second aspect of the invention, the numeric change section operates so as to advance or delay the phase of either of the output pulses or advance the phase of either of the output pulses and delay the phase of the other.

According to the configuration, if output pulse phase approach between the nearby light emitting elements occurs in the low-brightness area and the high-brightness area of the ΔΣ modulators, the mutual phases can be dispersed and consequently flicker noise in the whole light emission display is decreased, so that a light emission display drive apparatus sufficient in image quality as gradation representation of light emitting elements can be provided.

According to the second aspect of the invention, each ΔΣ modulator between the nearby light emitting elements comprises an integration section including an addition section and a delay section for delaying output of the addition section a predetermined time, a comparison and determination section for comparing the output value of the integration section with a predetermined value for determination, a detection section for detecting phase approach based on the value of each ΔΣ modulator, and a numeric change section for adding change to the value of the integration section of each ΔΣ modulator in response to the result of the detection section.

According to the configuration, if output pulse phase approach between the nearby light emitting elements occurs in the low-brightness area and the high-brightness area, regardless of the order of the ΔΣ modulator, the mutual phases can be dispersed and consequently flicker noise in the whole light emission display is decreased, so that a light emission display drive apparatus sufficient in image quality as gradation representation of light emitting elements can be provided.

According to the second aspect of the invention, each ΔΣ modulator between the nearby light emitting elements comprises a first integration section including a first addition section and a first delay section for delaying output of the first addition section a predetermined time, a second integration section including a second addition section connected to the first integration section and a second delay section for delaying output of the second addition section a predetermined time, a comparison and determination section for comparing the output value of the second integration section with a predetermined value for determination, a detection section for detecting phase approach based on the value of each ΔΣ modulator, and a numeric change section for adding change to the value of the first or second integration section of each ΔΣ modulator in response to the result of the detection section.

According to the configuration, when the order of the ΔΣ modulator is the second order or higher, if output pulse phase approach between the nearby light emitting elements occurs in the low-brightness area and the high-brightness area, the mutual phases can be dispersed and consequently flicker noise in the whole light emission display is decreased, so that a light emission display drive apparatus sufficient in image quality as gradation representation of light emitting elements can be provided.

DETAILED DESCRIPTION OF THE PRESENT INVENTION

The present invention will be described with reference to the accompanying drawings.

Figure 1:
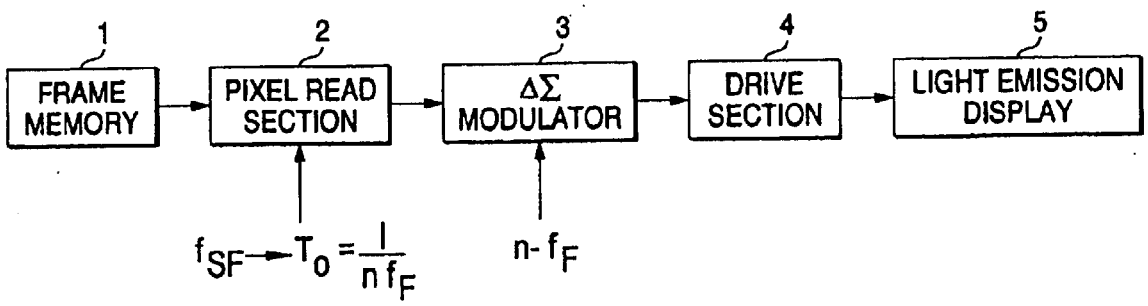
FIG. 1 is a block diagram to show one embodiment of a light emission display drive apparatus in the invention.

FIG. 1 is a block diagram to show an embodiment of a light emission display drive apparatus in the invention.

The light emission display drive circuit of the invention comprises a frame memory 1, a pixel read section 2, a ΔΣ modulator 3, a drive section 4, and a light emission display 5.

Pixel data is written in the frame memory 1. The pixel read section 2 reads the pixel data from the frame memory 1 in synchronization with a subframe pulse $f_{SF}$ repeatedly output in a subframe defined by time $T_D$ (=1/n$f_F$) of one-nth of a frame period and outputs the pixel data to the ΔΣ modulator 3. The drive section 4 turns on/off a drive current in response to output of the ΔΣ modulator 3 and supplies the drive current to the light emission display 5 for providing any desired multiple-step gradation display.

Figure 2:
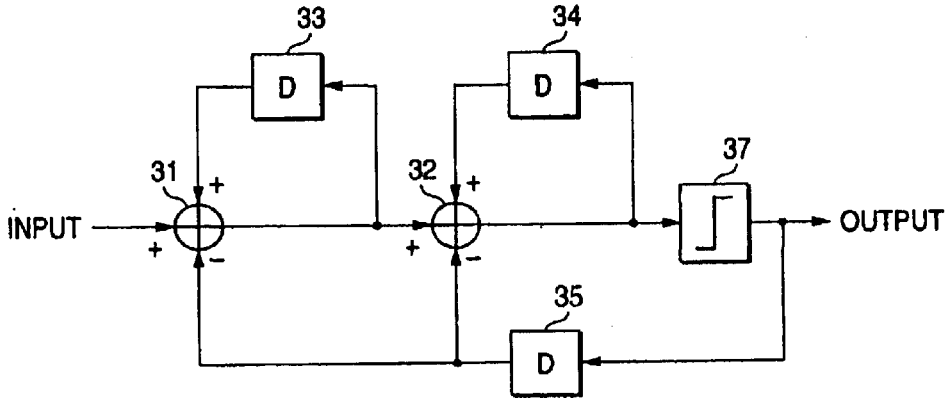
FIG. 2 is a block diagram to show one example of the internal configuration of a ΔΣ modulator shown in FIG. 1.

FIG. 2 is a block diagram to show the internal configuration of the ΔΣ modulator in FIG. 1; here, second-order ΔΣ modulator is illustrated.

The second-order ΔΣ modulator 3 shown in FIG. 2 comprises a first integration section including a first addition section 31 and a first delay section 33 for delaying output of the first addition section 31 a predetermined time, a second integration section including a second addition section 32 connected to the first integration section and a second delay section 34 for delaying output of the second addition section 32 a predetermined time, a comparison and determination section 37 for comparing an output value of the second integration section with a predetermined value for determination, and a third delay section 3435.

Specifically, the second addition section 32 and the second delay section 34 are added between the first addition section 31 and the comparison and determination section 37 of a first-order ΔΣ modulator including the first addition section 31, the first delay section 33 and the second delay section 34 each for delaying a signal the time TD (=1/n$f_F$) of the subframe time period, and the comparison and determination section 37 for outputting a positive predetermined value if the output value from the first addition section 31 is greater than a setup value and outputting a negative predetermined value if the output value is less than the setup value.

The first addition section 31, the second addition section 32, the first delay section 33, the second delay section 34, the third delay section 35, and the comparison and determination section 37 are represented as functional blocks, but are all arithmetic operation circuits having the specifications described above.

In the described configuration, as input to the first addition section 31 (brightness data converted into two steps of −255 to +255), the same data is repeatedly supplied during one frame period from the frame memory 1 through the pixel read section 2 and in the next frame period, the pixel data at the same position in the next frame is input.

The first addition section 31 adds the output value of the first delay section 33 to the input brightness data and output of the third delay section 35 is subtracted and output to the comparison and determination section 37, which then makes a comparison and a determination. The threshold value of the comparison and determination section 37 is 0. Here, an odd group is applied and thus = does not result. Output of the first addition section 31 is delayed $T_D$ (=1/n$f_F$) by the first delay section 33 and is returned to the first addition section 31, and a predetermined value output by the comparison and determination section 37 is delayed the $T_D$ time by the third delay section 35 and is returned to the first addition section 31. Therefore, as the output of the first addition section 31, the addition result is changed every $T_D$ time and the changed addition result is determined by the comparison and determination section 37 and the determination result is output to the drive section 4 for turning on/off the drive current or the drive voltage. The output of the comparison and determination section 37 is a value of −259 or a value of +259. When − is applied, no light is emitted; when + is applied, light is emitted. The numeric values of each section form a system of an odd group taking all odd values and the numeric range is anywhere ± symmetric.

The second addition section 32 operates in a similar manner to that of the first addition section 31 and the delay time of the second delay section 34 is the same as that of the first delay section 33 and that of the third delay section 35. The order of the ΔΣ modulator is raised, whereby the noise component distribution can be shifted to the high-frequency area side, so that the S/N ratio of a low-frequency area can be raised.

On the other hand, as white peak, light is emitted at a ratio of 257/259 from input of +255 and output of 259−X+(−259)(1−X)=255, X=257/259. On the other hand, as black bottom, light is emitted at a ratio of 2/259 and therefore the contrast on the drive circuit becomes 257:2.

Since the control signal to turn on/off the drive current or the drive voltage every subframe divided into n parts is thus determined by the output value resulting from ΔΣ modulation every subframe for the brightness data every frame of each pixel, if n is made smaller than $2^k-1$, necessary S/N ratio can be provided in the Nyquist band of $f_{SF}/2$. Therefore, it is made possible to prevent degradation of the quality of the image to be reproduced.

Figure 3:
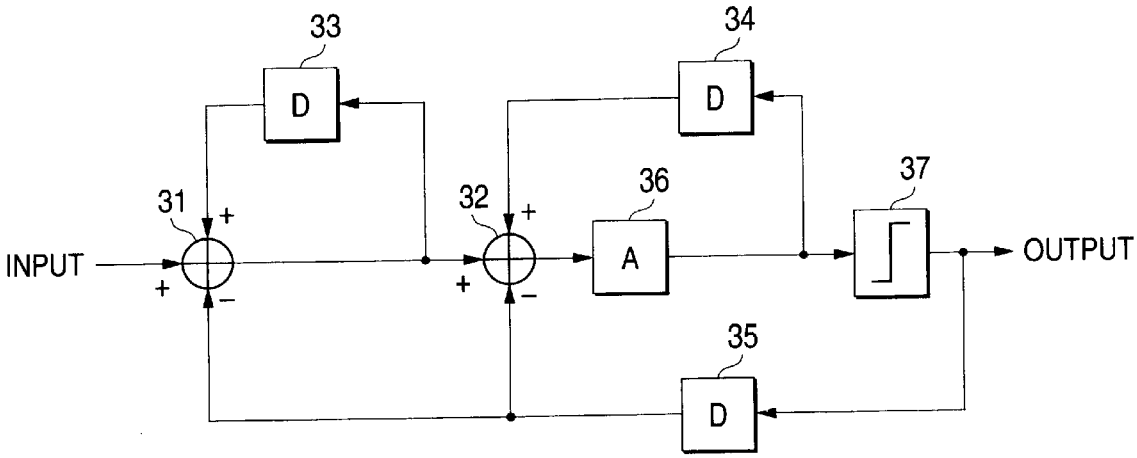
FIG. 3 is a block diagram to show one example of the internal configuration of the ΔΣ modulator shown in FIG. 1.

In the invention, if a clot of two pulses occurs in the operation of the ΔΣ modulator as described above, it is dispersed in time sequence and the output pulses of the comparison and determination section 37 are brought close to the uniform time interval. Thus, as shown in FIG. 3, an output change section 36 having specification of bringing (offsetting) the output value of the second addition section 32 close to the center value by a predetermined value if output of the second addition section 32 exceeds one range is added between the first addition section 31 and the comparison and determination section 37 of second-order or higher, ΔΣ modulator. The output change section 36 plays a role in loosening the pulse clot in the same pixel and dispersing the pulse clot in time sequence in the proximity of the black bottom, the white bottom, as described later. Others are similar to those in the example shown in FIG. 2.

Figure 4:
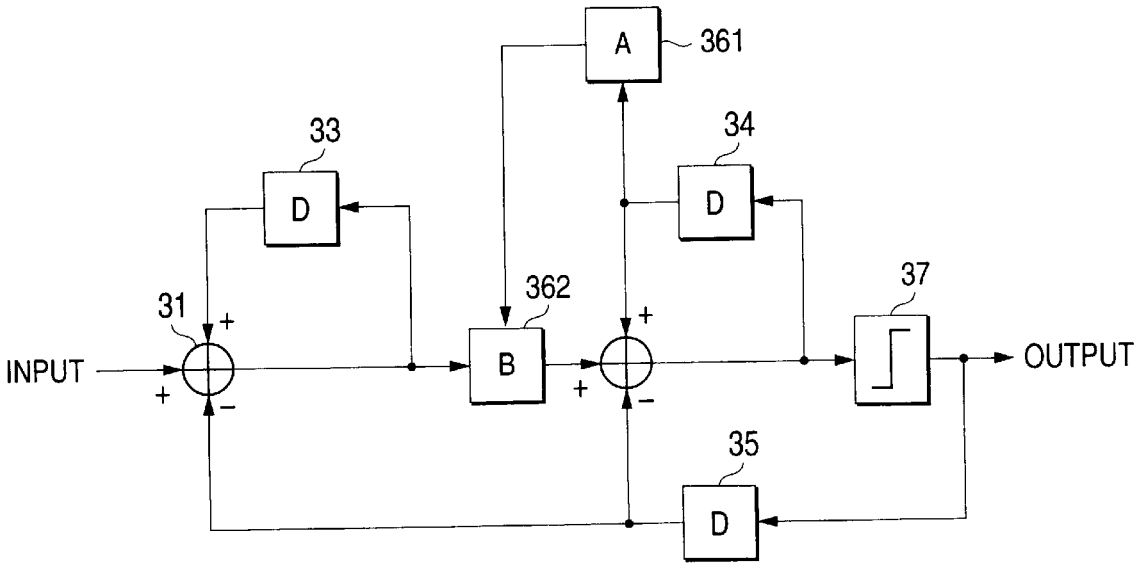
FIG. 4 is a block diagram to show one example of the internal configuration of the ΔΣ modulator shown in FIG. 1.

In the example, a detection section for detecting output of the second addition section 32 exceeding one range and a numeric change section for changing the output are integrated into the out put change section 36. However,a detection section 361 and a numeric change section 362 may be separate as shown in FIG. 4. Others are similar to those in the example shown in FIG. 2 or 3.

The operation of dispersing a pulse clot in the same pixel time sequence, specifically the operation principle of the output change section 36 (361 and 362) for changing the value of the first or second integration section in response to the comparison and determination result of the comparison and determination section 37 will be discussed with reference to FIG. 5.

Figure 5:
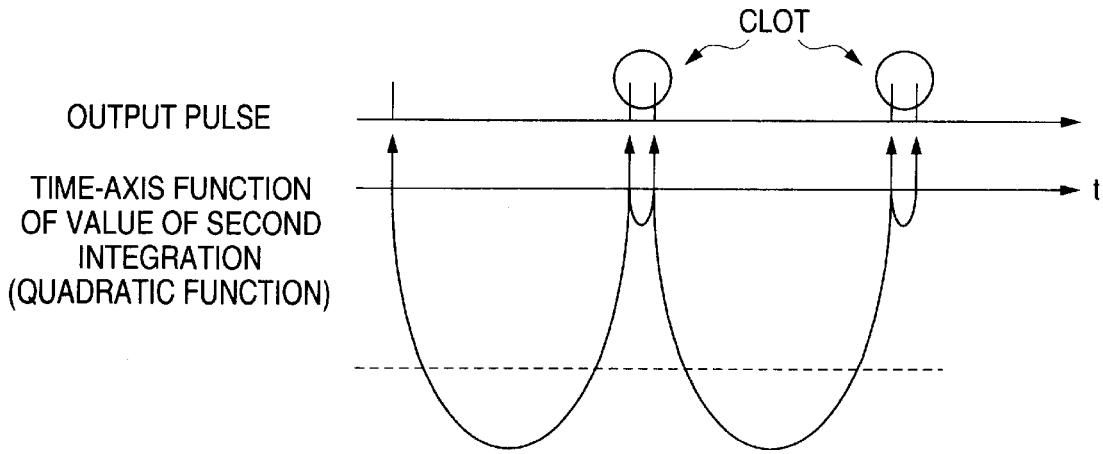
FIG. 5 is an operation conceptual drawing cited to describe the operation of an embodiment of the invention.
Figure 6:
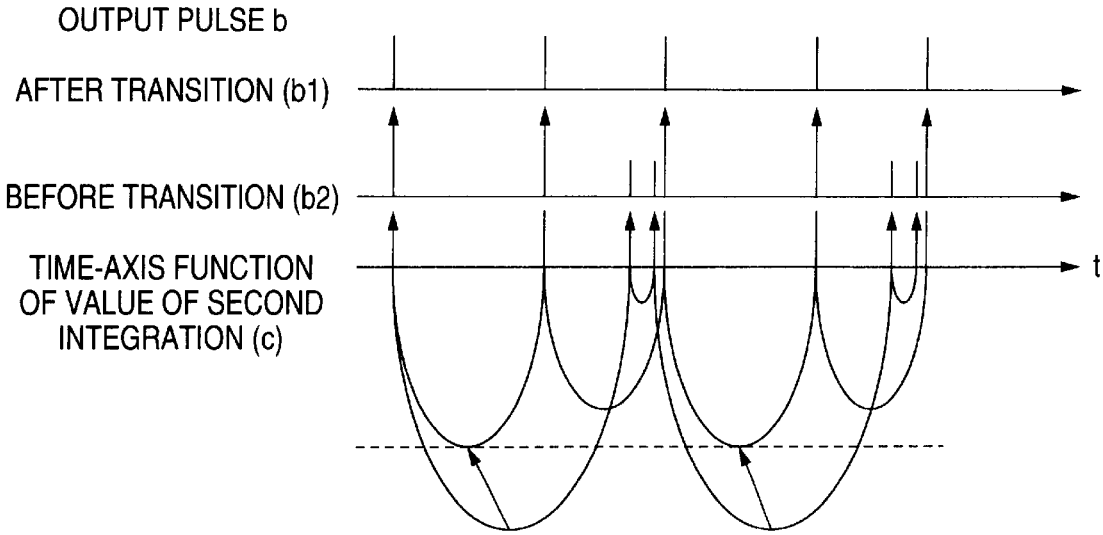
FIG. 6 is an operation conceptual drawing cited to describe the operation of the embodiment of the invention.

FIG. 5 is an operation conceptual drawing to show the relationship between a numeric function a (quadratic function) of the second integration section and output pulse b on a time axis (t). In the figure, the circled output pulse indicates a clot portion and as the clot is produced, for the time function a of the numeric value of the second integration, the interval between clots is widened and the tip of the parabola exceeds one threshold value (determination level). When exceeding the determination level is detected, pulse unevenness is determined to occur.

When the numeric value of the second integration exceeds one level, the output change section 36 adds a predetermined numeric value to the numeric value for bringing (offsetting) close to the center value by predetermined value, whereby the output pulse intervals become even. This is shown as time function (c) of the numeric value of the second integration before transition of output pulse (b2) and after transition (b1).

Figure 7:
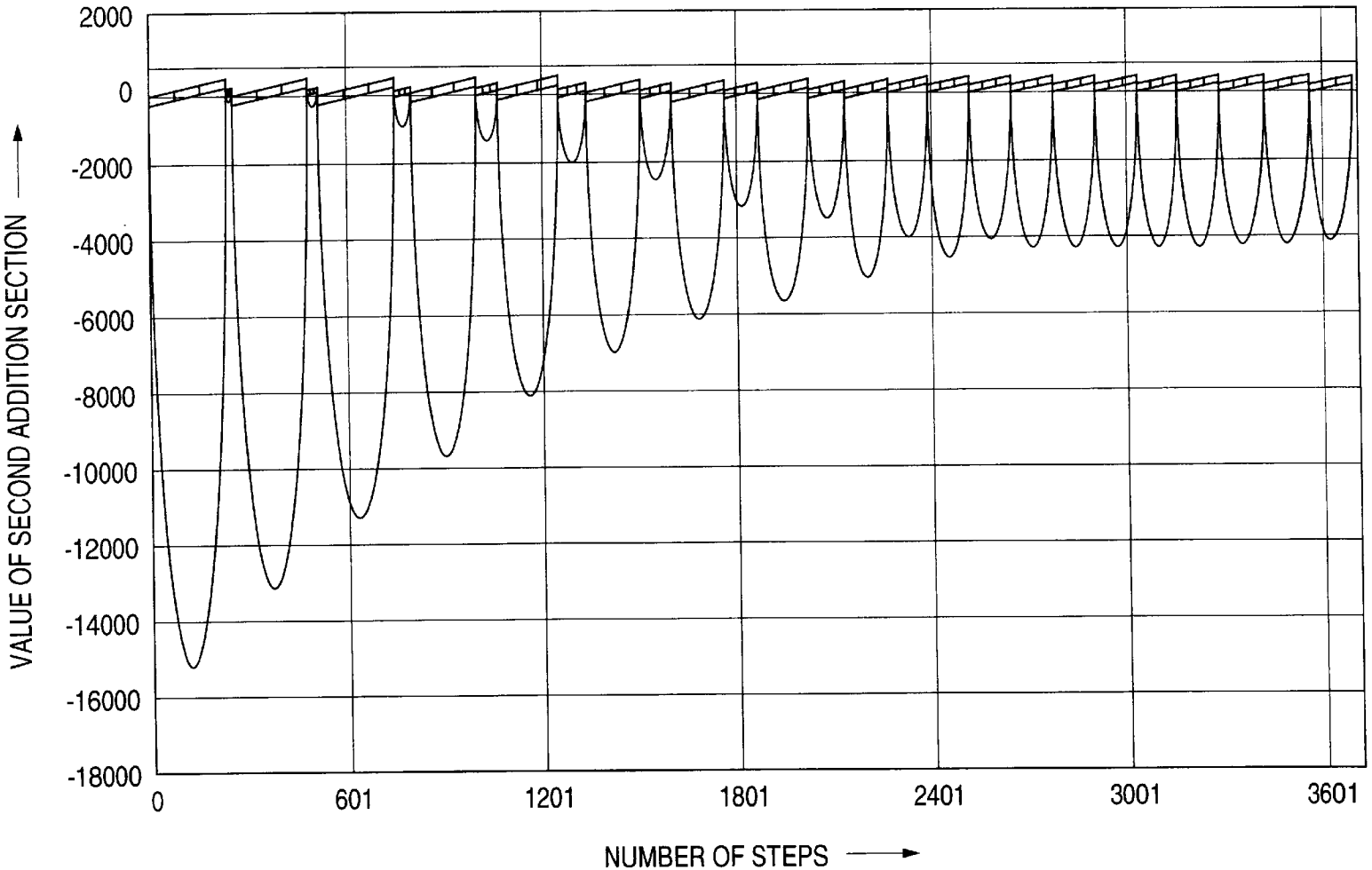
FIG. 7 is a graph cited to describe the operation of the embodiment of the invention.
Figure 8:
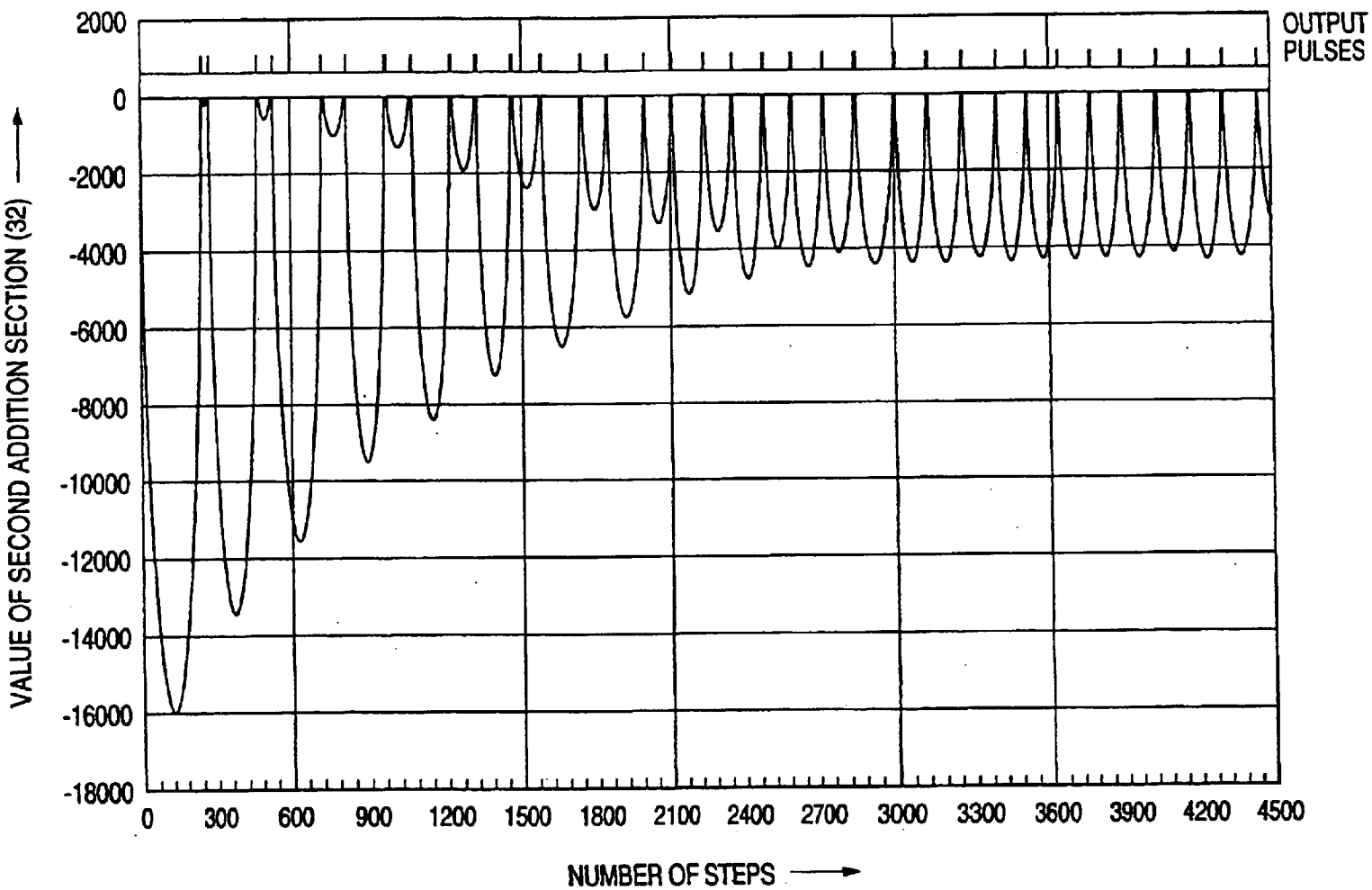
FIG. 8 is a graph cited to describe the operation of the embodiment of the invention.

FIGS. 7 and 8 are graphs cited to describe the operation of the embodiment of the invention shown in FIG. 3 and that shown in FIG. 4, and show examples of generating leakage when the second addition section 32 outputs −8600 or less and when the second addition section 32 outputs −4500 or less; the output values of the second addition section 32 are plotted on the vertical axis and the numbers of steps are plotted on the horizontal axis and quadratic function output pulse waveforms are shown.

The operation of the embodiment of the invention shown in FIG. 3 and that shown in FIG. 4 will be discussed in detail with reference to FIGS. 7 and 8.

The output change section 36 (361 and 362) always monitors output of the second addition section 32. As shown in FIG. 7 (output pulse chart) if input AX (output of the second addition section 32) is less than −8600, the output change section 36 outputs AX+16; if AX is greater than +8600, the output change section 36 outputs AX−16; if AX is greater than −8600 and less than +8600, the out put change section 36 outputs input AX intact. That is, if the output of the second addition section 32 exceeds one range (in this case, 8600), leakage is produced toward 0.

FIG. 8 shows the operation of producing leakage when the output of the second addition section 32 is less than −4500 for dispersing a clot of two pulses as quadratic function waveforms.

As described above, in the invention, the brightness value of each light emitting element is read in a predetermined period, ΔΣ modulation is conducted in a predetermined period in response to the read brightness value, and in the same light emitting element, the output pulses of the ΔΣ modulation are dispersed in time sequence, whereby flicker noise occurring in the low-brightness area and the high-brightness area can be suppressed.

In the embodiment of the invention, only the second-order ΔΣ modulator 3 is taken as an example, but the ΔΣ modulator 3 is not limited to the second-order ΔΣ modulator and if an n-order ΔΣ modulator is used, a similar advantage can be provided and the order of the ΔΣ modulator 3 is raised, whereby the noise component distribution can be shifted to the high-frequency area side, so that the S/N ratio of the low-frequency area can be raised. In the embodiment of the intention, a modulation section is placed at the stage following the second addition section 32; however, if it is placed anywhere in the periphery of the second addition section 32, a similar advantage can be provided.

In the present invention, the ΔΣ modulator 3 may be configured as shown in FIGS. 10–13. Such a ΔΣ modulator 3 will be described below.

In the invention, as described above, the phases of mutual pulses between nearby pixels are dispersed and the output pulses of the second addition section 32 are placed at uniform time intervals. Thus, the ΔΣ modulator 3 includes a detection section for detecting the phase difference of output pulses of ΔΣ modulation between the nearby light emitting elements among light emitting elements, which will be hereinafter referred to as overlap detection section 38, and a numeric change section operating so as to disperse the phases of the output pulses of the ΔΣ modulator in the nearby light emitting elements based on the result of the detection section, which will be hereinafter referred to as arithmetic operation section 36.

Figure 9:
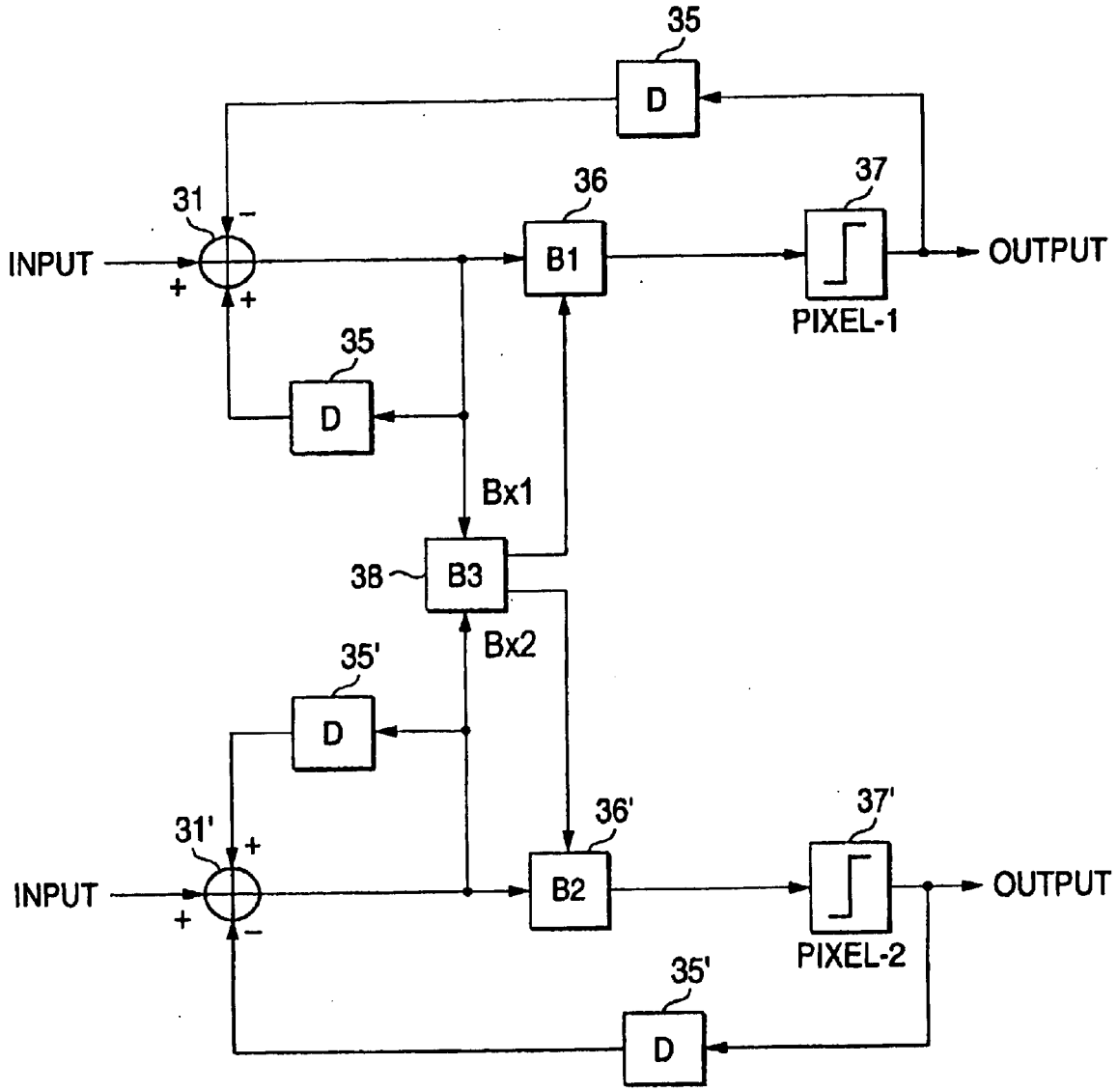
FIG. 9 is a block diagram to show one example of the internal configuration of the ΔΣ modulator shown in FIG. 1.

In the embodiment shown in FIG. 9, an application example to a first-order ΔΣ modulator is shown. An overlap detection section (B3) 38 for adding crosstalk from the adjacent light emitting element and changing the phase of a delay circuit 35 in response to the addition output is added to components of the ΔΣ modulator 3 between the first-order ΔΣ modulators in the adjacent pixels In each adjacent ΔΣ modulator 3, an arithmetic operation section 36, 36 ' (B1, B2) for outputting a numeric value responsive to output of an adder 31 (31') is added between the addition section 31 (31') and a comparison and determination section 37 (37').

The overlap detection section (B3) 38 detects phase overlap in output of each delay circuit 35 (35') based on output of the arithmetic operation section 36 (36') in each adjacent pixel. That is, the overlap detection section 38 detects both outputs of the addition sections 31 and 31'exceeding one range and at this time, the arithmetic operation section 36 (36') adds a predetermined value for advancing the phase of one of the adjacent light emitting elements and the arithmetic operation section 36' (36) adds a predetermined value for delaying the phase of the other for dispersing the mutual phases. A detailed description will be given later.

The arithmetic operation sections 36 and 36' and the overlap detection section 38 in the adjacent pixels are collectively called output change section. The output change section plays a role in dispersing the mutual phases between the adjacent pixels in the proximity of the black bottom, the white bottom, as described later.

Figure 10:
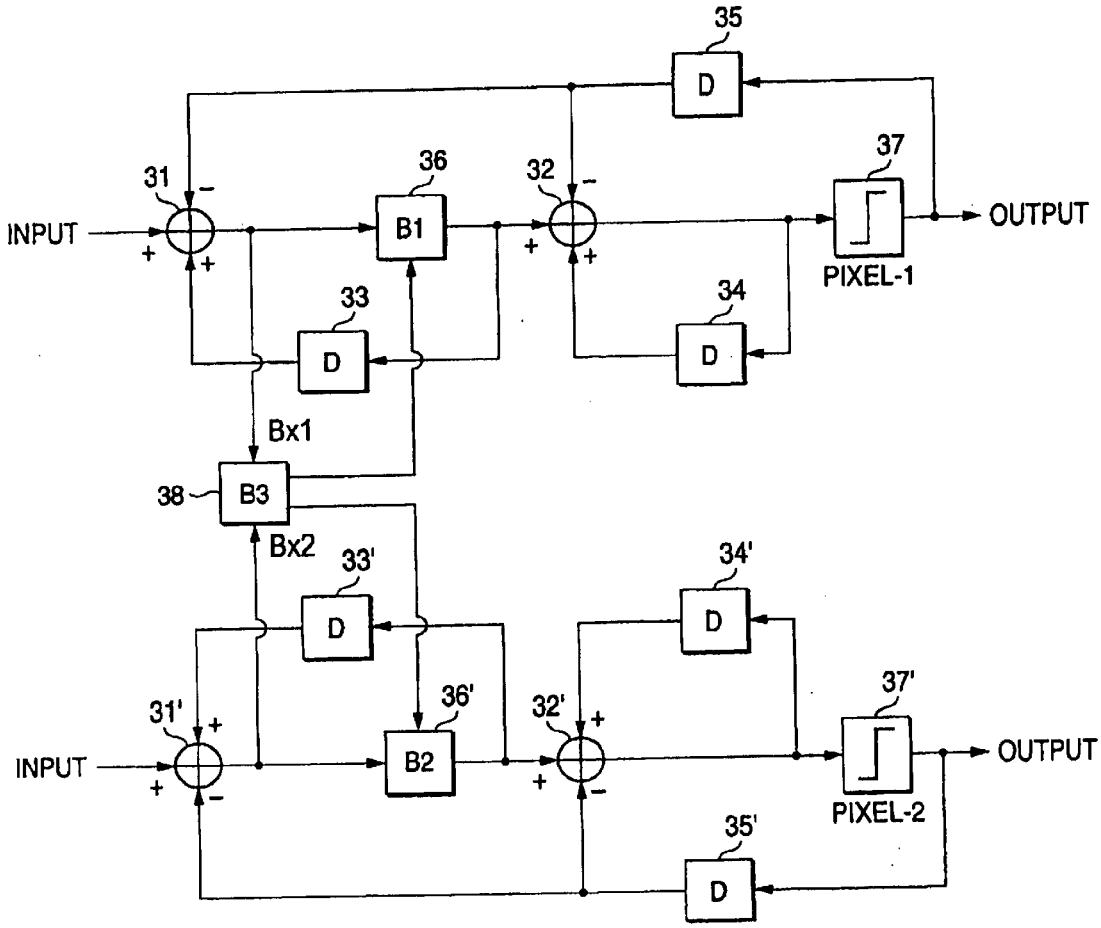
FIG. 10 is a block diagram to show one example of the internal configuration of the ΔΣ modulator shown in FIG. 1.

In the embodiments shown in FIG. 10 and the later figures, application examples to second-order ΔΣ modulators are shown In the embodiment shown in FIG. 10, an overlap detection section 38 for adding crosstalk from the adjacent light emitting element and changing the phase of a first delay circuit 33 (33') in response to the addition output is added between the second-order ΔΣ modulators in the adjacent pixels. In each adjacent ΔΣ modulator 3, an arithmetic operation section 36 (36') for outputting a numeric value responsive to output of a first addition section 31 (31') is added between the first addition section 31 (31') and a second addition section 32 (32'). This is an example wherein the arithmetic operation section 36 as numeric change section is placed in first integration section.

The overlap detection section 38 detects phase overlap in output of each first delay section 33 (33') based on output of the arithmetic operation section 36 (36') in each adjacent pixel. That is, the overlap detection section 38 detects both outputs of the first addition sections 31 (31') exceeding one range and at this time, the arithmetic operation section 36 (36') adds a predetermined value for advancing the phase of one of the adjacent light emitting elements and the arithmetic operation section 36' (36) adds a predetermined value for delaying the phase of the other for dispersing the mutual phases. A detailed description will be given later.

Figure 11:
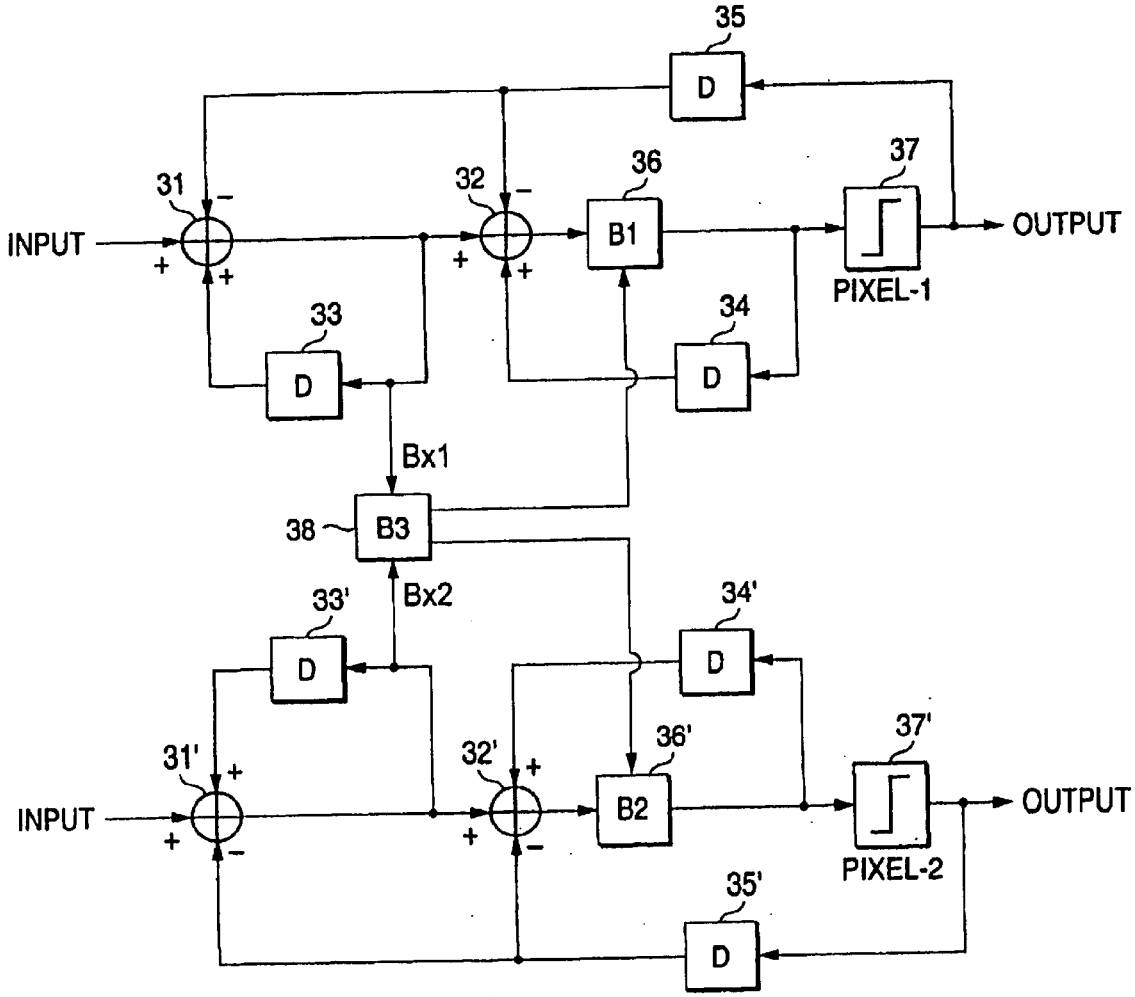
FIG. 11 is a block diagram to show one example of the internal configuration of the ΔΣ modulator shown in FIG. 1.

In the embodiment shown in FIG. 11, in each adjacent ΔΣ modulator 3, an arithmetic operation section 36 (36') for outputting a numeric value responsive to output of a second addition section 32 (32') is added between the second addition section 32 (32') and a comparison and determination section 37 (37') Here, an overlap detection section 38 detects phase overlap in output of each delay section 33 (33') based on output of the arithmetic operation section 36 (36') in each adjacent pixel. That is, the overlap detection section 38 detects both outputs of first addition sections 31 (31') exceeding one range and at this time, the arithmetic operation section 36 (36') adds a predetermined value for advancing the phase of one of the adjacent light emitting elements and the arithmetic operation section 36' (36) adds a predetermined value for delaying the phase of the other for dispersing the mutual phases. A detailed description will be given later. Others are similar to the embodiment previously described with reference to FIG. 10. Here, an example wherein the arithmetic operation section 36 as numeric change section is placed in second integration section is shown.

Figure 12:
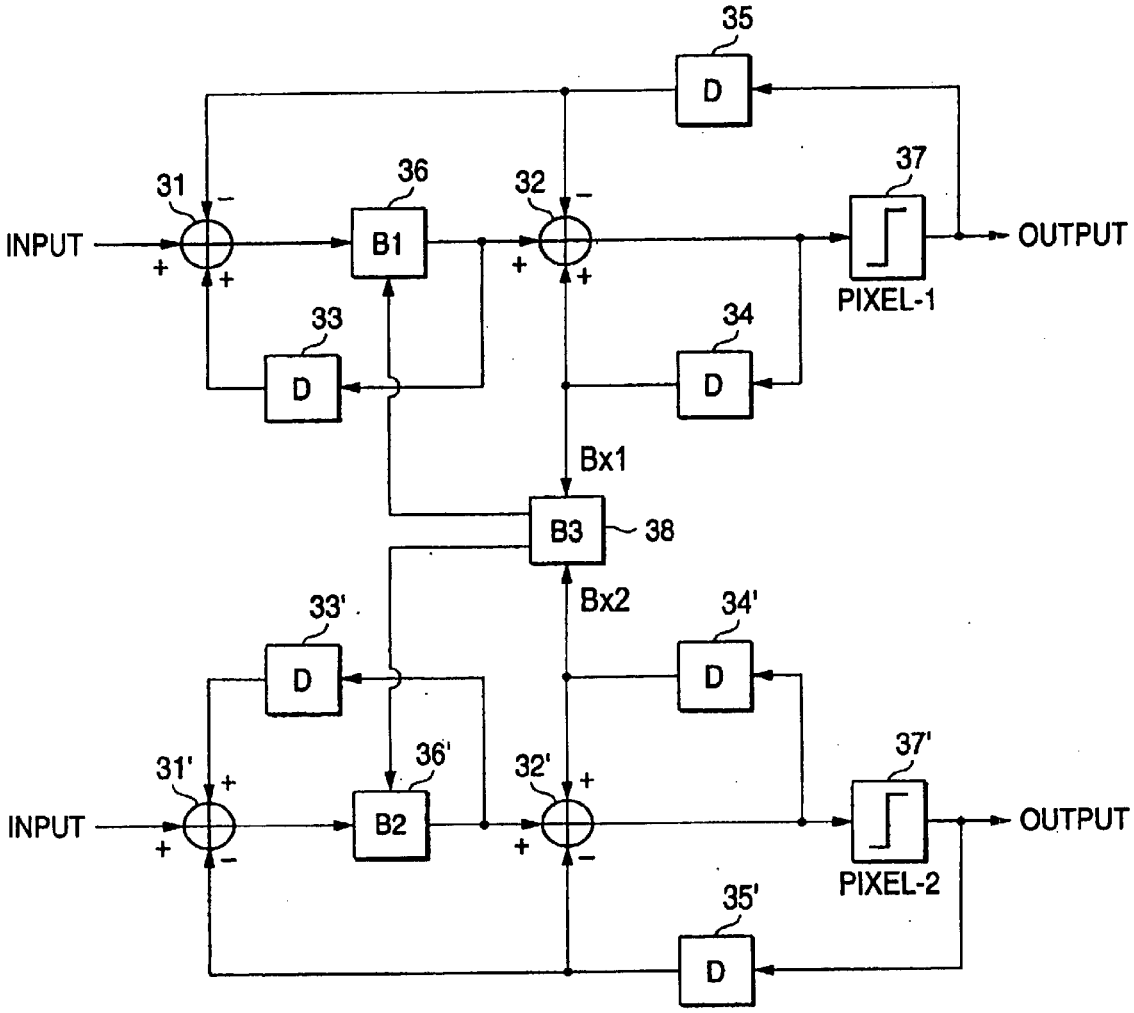
FIG. 12 is a block diagram to show one example of the internal configuration of the ΔΣ modulator shown in FIG. 1.

In the embodiment shown in FIG. 12, in each adjacent ΔΣ modulator 3, an arithmetic operation section 36 (36') for outputting a numeric value responsive to output of a first addition section 31 (31') is added between the first addition section 31 (31') and a second addition section 32 (32'). An overlap detection section 38 detects phase overlap in output of each delay section 34 (34') based on output of the arithmetic operation section 36 (36') in each adjacent pixel. That is, the overlap detection section 38 detects both outputs of the first addition sections 31 and 31' exceeding one range and at this time, the arithmetic operation section 36 (36') adds a predetermined value for advancing the phase of one of the adjacent light emitting elements and the arithmetic operation section 36' (36) adds a predetermined value for delaying the phase of the other for dispersing the mutual phases. Others are similar to the embodiment previously described with reference to FIG. 10. Here, an example wherein the arithmetic operation section 36 as numeric change section is placed in first integration section is shown, but the arithmetic operation section 36 may be placed in output of the first integration section as in the embodiment shown in FIG. 9.

Figure 13:
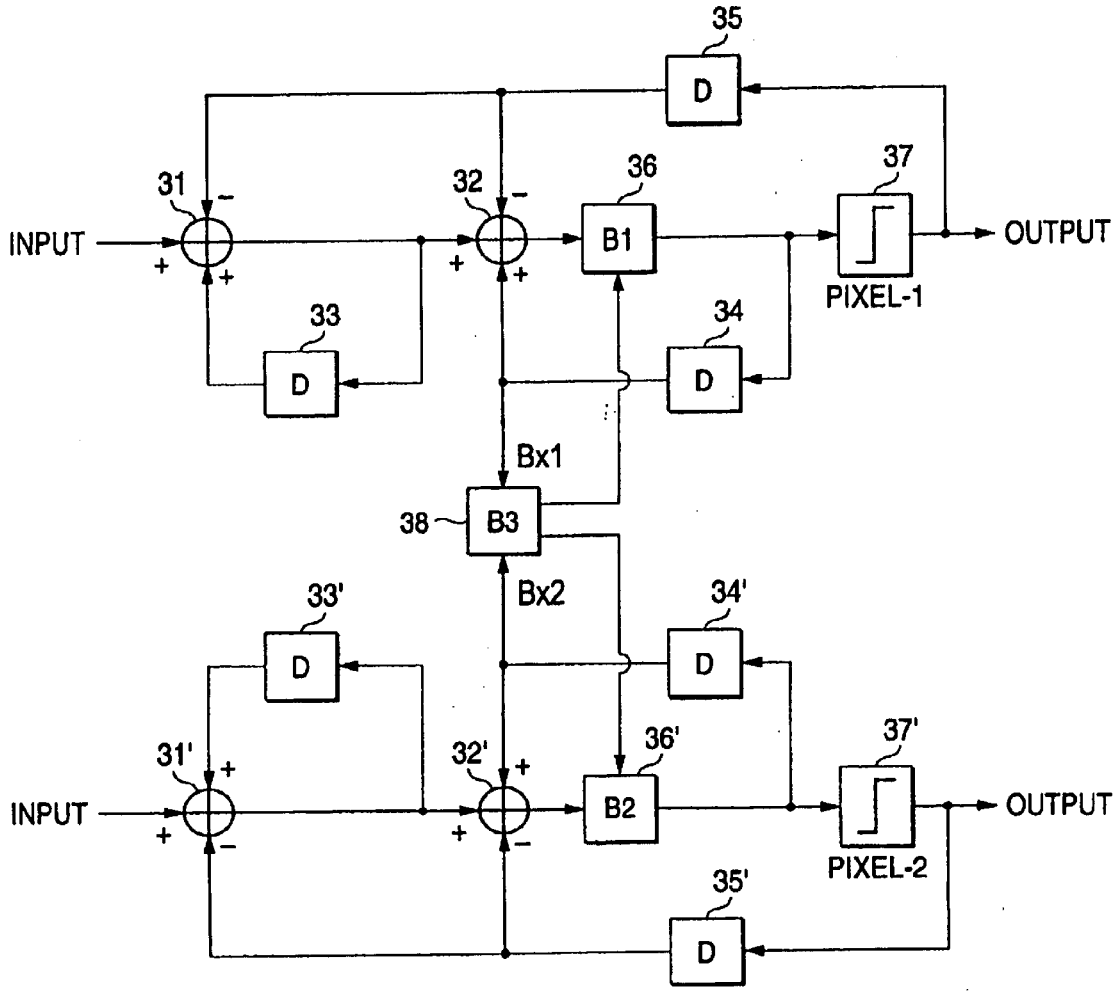
FIG. 13 is a block diagram to show one example of the internal configuration of the ΔΣ modulator shown in FIG. 1.

In the embodiment shown in FIG. 13, in each adjacent ΔΣ modulator 3, an arithmetic operation section 36 (36') for outputting a numeric value responsive to output of a second addition section 32 (32') is added between the second addition section 32 (32') and a comparison and determination section 37 (37'). An over lap detection section 38 detects phase overlap in output of each delay circuit 34 (34') based on output of the arithmetic operation section 36 (36') in each adjacent pixel. That is, the overlap detection section 38 detects both outputs of the second addition sections 32 (32') exceeding one range and at this time, the arithmetic operation section 36 (36') adds a predetermined value for advancing the phase of one of the adjacent light emitting elements and the arithmetic operation section 36' (36) adds a predetermined value for delaying the phase of the other for dispersing the mutual phases. Others are similar to the embodiment previously described with reference to FIG. 10 Here, an example wherein the arithmetic operation section 36 as numeric change section is placed in second integration section is shown, but the arithmetic operation section 36 may be placed in output of the second integration section.

Figure 14:
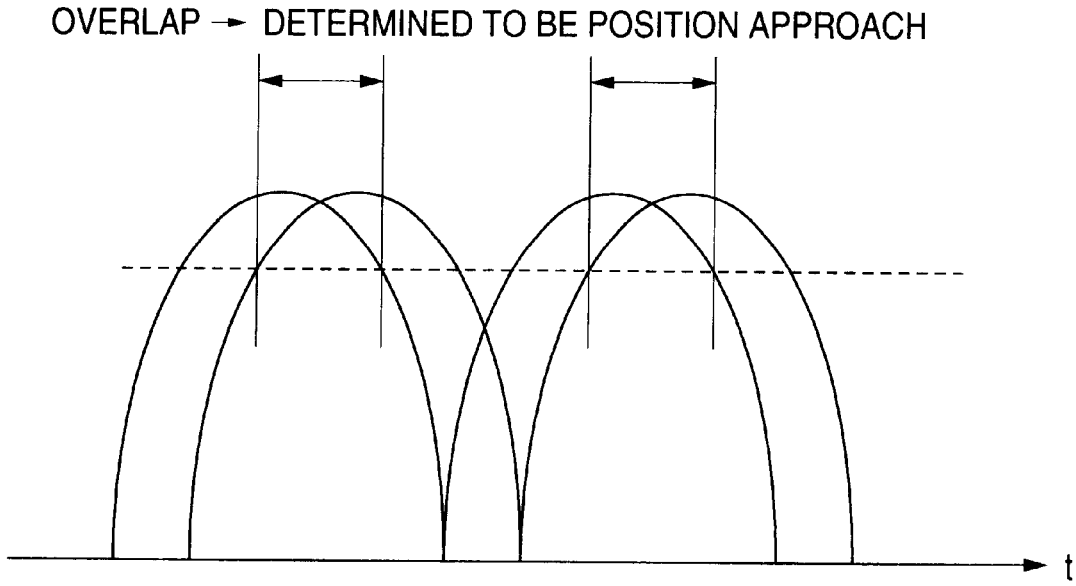
FIG. 14 is an operation conceptual drawing cited to describe the operation of embodiments of the invention.
Figure 15:
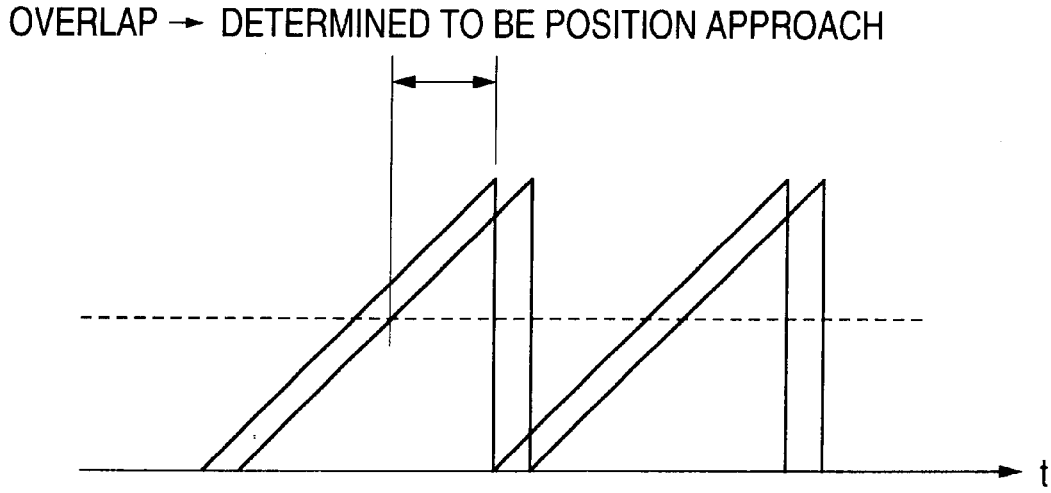
FIG. 15 is an operation conceptual drawing cited to describe the operation of embodiments of the invention.

FIGS. 14 and 15 are drawings cited to describe the operation of the embodiment of the invention and specifically are drawings to conceptually show methods of detecting and determining approach of phases each other by the overlap detection section 38.

FIG. 14 shows an example of detecting and determining mutual overlap based on the numeric values of the first integration section in two nearby pixels. Since the numeric values of the first integration section become a waveform comprising linear functions concatenated like a sawtooth form as shown in FIG. 14, when both the numeric values of the first integration section of the two nearby pixels exceed a determination level (indicated by the dotted line in the figure) at the same level, phase approach is determined to occur and phase dispersion processing for dispersing the phases is performed.

FIG. 15 shows an example of detecting and determining mutual overlap based on the numeric values of the second integration section of two nearby pixels. Since the numeric values of the second integration section become a waveform comprising quadratic functions concatenated as shown in FIG. 15, when both the numeric values of the second integration section of the two nearby pixels exceed a determination level (indicated by the dotted line in the figure) at the same level, phase approach is determined to occur and dispersion processing is performed.

Figure 16:
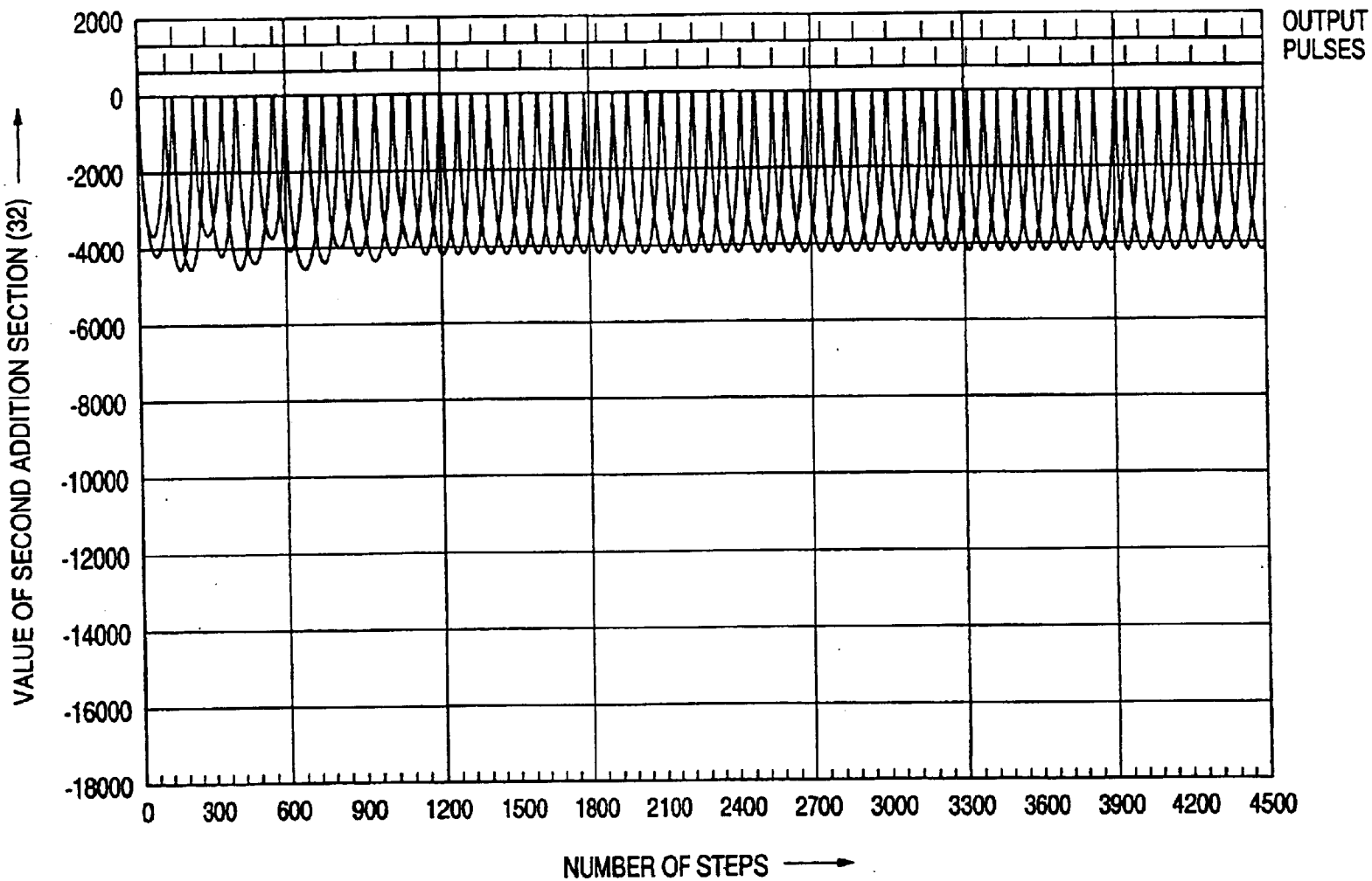
FIG. 16 is a graph cited to describe the operation of the embodiments of the invention.

FIG. 16 is a graph cited to describe the operation of the embodiments of the invention shown in FIGS. 10 to 13 and shows quadratic function output pulse waveforms with the output values of the second addition section plotted on the vertical axis and the numbers of steps plotted on the horizontal axis.

The operation of the embodiments of the invention shown in FIGS. 10 to 13 will be discussed in detail with reference to FIG. 16. The overlap detection section 38 and the arithmetic operation section 36 (36') making up the output change section always monitor output of the first addition section 31 (31') or the second addition section 32 (32') in each adjacent pixel. As shown in FIG. 16 (output pulse chart), if inputs of the overlap detection section 38 (here, BX1 and BX2 (outputs of first or second addition sections in adjacent pixels)) are BX1<−7000 and BX2<−7000, the arithmetic operation section 36 (B1) adds +2 and outputs the result and the arithmetic operation section 36' (B2) adds −2 and outputs the result. If BX1>+7000 and BX2>+7000, the arithmetic operation section 36 (B1) adds −2 and outputs the result and the arithmetic operation section 36' (B2) adds +2 and outputs the result. Otherwise, the arithmetic operation sections 36 and 36' out put through. That is, if both outputs of the second addition sections 32 and 32' exceed one range, the phase of the light emitting element (PIXEL-1) is advanced and the phase of the light emitting element (PIXEL-2) is delayed for dispersing the mutual phases. FIG. 16 shows pulse waveforms with pulse phases shifted.

In the embodiments of the invention, the method of suppressing flicker appearing in the proximity of the white peak, the black bottom by dispersing the pulse phases between the adjacent pixels has been described, but the same advantage can also be provided if a pulse clot is loosened in the same pixel and is dispersed in time sequence. FIG. 11 shows output pulse waveforms when both the methods are used in combination.

As described above,in the invention, the brightness value of each light emitting element undergoing multiple-step gradation control thereof is read in a predetermined period, ΔΣ modulation is conducted in a predetermined period in response to the read brightness value, and the phases of the output pulses of the ΔΣ modulation are dispersed between the adjacent nearby light emitting elements among the light emitting elements, whereby flicker noise occurring in the low-brightness area and the high-brightness area can be suppressed.

In the embodiments of the invention, only the first-order and second-order ΔΣ modulators 3 are taken as examples, but the ΔΣ modulators 3 are not limited to the first-order or second-order ΔΣ modulators and if an n-order ΔΣ modulator is used, a similar advantage can be provided and the order of the ΔΣ modulator 3 is raised, whereby the noise component distribution can be shifted to the high-frequency area side, so that the S/N ratio of the low-frequency area can be raised.

As described above, according to the invention, if an image signal is represented by k binary numbers, the drive section is driven, for example, at a drive rate lower than $(2^k-1)\cdot f_F$ (where $f_F$ is frame frequency) and the number of gradation steps corresponding to $2^K$ level can be provided equivalently in a reproducing band of a moving image, a frequency band of $f_F/2$ or less of so-called Nyquist band. In the same pixel, for example, a clot of two pulses is dispersed in time sequence and the output pulses of the second addition section are placed at uniform time intervals, so that flicker noise occurring in the low-brightness area and the high-brightness area can be suppressed; if the invention is applied to active matrix drive, etc., it can be made practicable in both fast responsivity and image quality.

What is claimed is:

1. A light emission display drive method for a light emission display drive circuit comprising an at least second-order ΔΣ modulator for turning on/off a constant drive current or a constant drive voltage, thereby performing gradation control of each light emitting element, the light emission display drive method comprising the steps of:

reading a brightness value of the light emitting element in a predetermined period;

performing ΔΣ modulation in a predetermined period according to the read brightness value;

detecting unevenness of a list of output pulses of the ΔΣ modulation; and dispersing the output pulses to perform the gradation control of the light emitting element.

2. A light emission display drive apparatus comprising:

a read section for reading a brightness value of each light emitting element in a predetermined period; and an at least second-order ΔΣ modulator for operating in a predetermined period according to the read brightness value, wherein the ΔΣ modulator includes an arithmetic operation section for detecting unevenness of a list of output pulses and dispersing the output pulses.

3. The light emission display drive apparatus as claimed in claim 2 wherein the at least second-order ΔΣ modulator comprises:

a first integration section including a first addition section and a first delay section for delaying output of the first addition section a predetermined time;

a second integration section including a second addition section connected to the first integration section and a second delay section for delaying output of the second addition section a predetermined time;

a comparison and determination section for comparing an output value of the second integration section with a predetermined value for determination;

a detection section for detecting unevenness of a list of output pulses based on the value of the second integration section; and a numeric change section for adding change to the value of the first or second integration section in response to the result of the detection section.

4. The light emission display drive apparatus as claimed in claim 3 wherein the detection section detects output of the second addition section exceeding one numeric range; and the numeric change section adds the numeric change of bringing the output value of the second addition section close to the center value by a predetermined value only if the detection section detects output of the second addition section exceeding the numeric range.

5. A light emission display drive method for a light emission display drive circuit comprising a ΔΣ modulator for turning on/off a constant drive current or a constant drive voltage, thereby performing gradation control of each light emitting element, the light emission display drive method comprising the steps of:

reading a brightness value of the light emitting element in a predetermined period;

performing ΔΣ modulation in a predetermined period according to the read brightness value; and dispersing phases of output pulses of the ΔΣ modulation between nearby light emitting elements among the light emitting elements, thereby performing the gradation control of the light emitting element.

6. A light emission display drive apparatus comprising:

a read section for reading a brightness value of each light emitting element in a predetermined period; and a ΔΣ modulator for operating in a predetermined period in response to the read brightness value, wherein the ΔΣ modulator disperses phases of output pulses of ΔΣ modulation between nearby light emitting elements among the light emitting elements.

7. The light emission display drive apparatus as claimed in claim 6 wherein the ΔΣ modulator comprises:

a detection section for detecting a phase difference of output pulses of the ΔΣ modulation between the nearby light emitting elements among the light emitting elements; and a numeric change section operating so as to disperse the phases of the output pulses of the ΔΣ modulator in the nearby light emitting elements based on the result of the detection section.

8. The light emission display drive apparatus as claimed in claim 7 wherein the numeric change section operates so as to advance or delay the phase of either of the output pulses or advance the phase of either of the output pulses and delay the phase of the other.

9. The light emission display drive apparatus as claimed in claim 7 wherein each ΔΣ modulator between the nearby light emitting elements comprises:

an integration section including an addition section and a delay section for delaying output of the addition section a predetermined time;

a comparison and determination section for comparing an output value of the integration section with a predetermined value for determination;

a detection section for detecting phase approach based on the value of each ΔΣ modulator; and a numeric change section for adding change to the value of the integration section of each ΔΣ modulator in response to the result of the detection section.

10. The light emission display drive apparatus as claimed in claim 7 wherein each ΔΣ modulator between the nearby light emitting elements comprises:

a first integration section including a first addition section and a first delay section for delaying output of the first addition section a predetermined time;

a second integration section including a second addition section connected to the first integration section and a second delay section for delaying output of the second addition section a predetermined time;

a comparison and determination section for comparing an output value of the second integration section with a predetermined value for determination;

a detection section for detecting phase approach based on the value of each ΔΣ modulator; and a numeric change section for adding change to the value of the first or second integration section of each ΔΣ modulator in response to the result of the detection section.

11. The light emission display drive apparatus as claimed in claim 8 wherein each ΔΣ modulator between the nearby light emitting elements comprises:

an integration section including an addition section and a delay section for delaying output of the addition section a predetermined time;

a comparison and determination section for comparing an output value of the integration section with a predetermined value for determination;

a detection section for detecting phase approach based on the value of each ΔΣ modulator; and a numeric change section for adding change to the value of the integration section of each ΔΣ modulator in response to the result of the detection section.

12. The light emission display drive apparatus as claimed in claim 8 wherein each ΔΣ modulator between the nearby light emitting elements comprises:

a first integration section including a first addition section and a first delay section for delaying output of the first addition section a predetermined time;

a second integration section including a second addition section connected to the first integration section and a second delay section for delaying output of the second addition section a predetermined time;

a comparison and determination section for comparing an output value of the second integration section with a predetermined value for determination;

a detection section for detecting phase approach based on the value of each ΔΣ modulator; and a numeric change section for adding change to the value of the first or second integration section of each ΔΣ modulator in response to the result of the detection section.

13. A drive method, comprising:

(a) performing modulation according to a brightness value for a portion of a display and generating a corresponding series of output pulses;

(b) detecting at least one error in the series of the output pulses; and (c) adjusting the output pulses based on the at least one error to control a brightness of the portion of the display.

14. The drive method according to claim 13, wherein the operation (b) comprises (b1) detecting an irregularity in spacing of the output pulses within the series of the output pulses.

15. The drive method according to claim 13, wherein the operation (c) comprises (c1) dispersing the output pulses to control the brightness of the portion of the display.

16. The drive method according to claim 14, wherein the operation (c) comprises (c1) dispersing the output pulses to control the brightness of the portion of the display.

17. The drive method according to claim 13, wherein the portion of the display is a pixel.

18. The drive method according to claim 13, wherein the operation (a) comprises (a1) performing the modulation with a ΔΣ modulator.

19. A drive apparatus, comprising:

a memory that stores a brightness value for a portion of a display; and a modulating circuit that generates a series of output pulses based on the brightness value, that detects at least one error in the series of the output pulses, and that adjusts the output pulses based on the at least one error.

20. The drive apparatus according to claim 19, wherein the at least one error comprises an irregularity in spacing of the output pulses within the series of the output pulses.

21. The drive apparatus according to claim 19, wherein the modulating circuit adjusts the output pulses by dispersing the output pulses.

22. The drive apparatus according to claim 20, wherein the modulating circuit adjusts the output pulses by dispersing the output pulses.

23. The drive apparatus according to claim 19, wherein the portion of the display is a pixel.

24. The drive apparatus according to claim 19, wherein the modulating circuit comprises a ΔΣ modulator with an order of at least two.

25. The drive apparatus as claimed in claim 19, wherein the modulating circuit comprises:

a first integration circuit having a first adding circuit and a first delay circuit, wherein the first delay circuit delays an output of the first adding circuit;

a second integration circuit having a second adding circuit and a second delay circuit, wherein the second adding circuit is connected to the first integration circuit, and wherein the second delay circuit delays an output of the second adding circuit;

a comparison circuit that compares an output value of the second integration circuit with a predetermined value;

a detection circuit that detects the at least one error in the series of the output pulses based on the output value of the second integration circuit; and an adjusting circuit that adjusts the output value of the first or second integration circuit based on the at least one error.

26. The drive apparatus according to claim 25, wherein the at least one error comprises an irregularity in spacing of the output pulses within the series of the output pulses.

27. The drive apparatus as claimed in claim 25, wherein the detection circuit detects whether or not an output of the second adding circuit exceeds a predetermined numeric range, and wherein the adjusting circuit adjusts the output value of the second adding circuit to be closer to a central value of the numeric range if the detection circuit detects that the output of the second adding circuit exceeds the numeric range.

28. A drive method, comprising:

(a) performing a first modulation according to a first brightness value of a first portion of a display;

(b) generating a first series of output pulses based on the first modulation;

(c) performing a second modulation according to a second brightness value of a second portion of a display;

(d) generating a second series of output pulses based on the second modulation;

(e) adjusting a phase of at least one of the first series of the output pulses and the second series of the output pulses.

29. The drive method according to claim 28, wherein the first portion of the display comprises a first pixel, and wherein the second portion of the display comprises a second pixel that is adjacent to the first pixel.

30. A drive apparatus, comprising:

at least one memory that stores a first brightness value corresponding to a first portion of a display and that stores a second brightness value corresponding to a second portion of the display;

a modulating circuit that generates a first series of output pulses based on the first brightness value, that generates a second series of output pulses based on the second brightness value, and that adjusts a phase of at least one of the first series of the output pulses and the second series of the output pulses.

31. The drive apparatus according to claim 30, wherein the first portion of the display comprises a first pixel, and wherein the second portion of the display comprises a second pixel that is adjacent to the first pixel.

32. The drive apparatus according to claim 30, wherein the modulating circuit comprises:

a detection circuit that detects a phase difference of the output pulses of the first series of output pulses and the second series of output pulses; and an adjusting circuit that adjusts the phase of at least one of the first series of the output pulses and the second series of the output pulses based on the phase difference.

33. The drive apparatus according to claim 32, wherein the adjusting circuit advances or delays the phase of only the first series of the output pulses and does not adjust the phase of the second series of the output pulses.

34. The drive apparatus according to claim 32, wherein the adjusting circuit advances the phase of the first series of the output pulses and delays the phase of the second series of the output pulses.

35. The drive apparatus according to claim 30, wherein the modulating circuit comprises:

a first integration circuit that processes the first brightness value for the first portion of the display, wherein the first integration circuit comprises a first adding circuit and a first delay circuit that at least indirectly delays an output of the first adding circuit;

a second integration circuit that processes the second brightness value for the second portion of the display, wherein the second integration circuit comprises a second adding circuit and a second delay circuit that at least indirectly delays an output of the second adding circuit;

a detection circuit that detects a phase different between the first series of the output pulses and the second series of the output pulses based on the output of the first adding circuit and the output of the second adding circuit; and an adjusting circuit that at least indirectly adjusts at least one of an output value from the first integration circuit and an output value from the second integration circuit based on the phase difference.

36. The drive apparatus according to claim 35, wherein the adjusting circuit comprises:

a first adjusting circuit that at least indirectly adjusts the output value from the first integration circuit; and a second adjusting circuit that at least indirectly adjusts the output value from the second integration circuit.

37. The drive apparatus according to claim 36, wherein the first delay circuit inputs the output of the first adding circuit.

38. The drive apparatus according to claim 37, wherein the second delay circuit inputs the output of the second adding circuit.

39. The drive apparatus according to claim 36, wherein the first delay circuit inputs an output of the first adjusting circuit.

40. The drive apparatus according to claim 39, wherein the second delay circuit inputs an output of the second adjusting circuit.

41. The drive apparatus according to claim 35, wherein the modulating circuit comprises:

a third integration circuit that comprises a third adding circuit connected to the first integration circuit and a third delay circuit that at least indirectly delays an output of the third adding circuit; and a fourth integration circuit that comprises a fourth adding circuit connected to the second integration circuit and a fourth delay circuit that at least indirectly delays an output of the fourth adding circuit.

42. The drive apparatus according to claim 41, wherein the adjusting circuit comprises:

a first adjusting circuit that at least indirectly adjusts the output value from the first integration circuit; and a second adjusting circuit that at least indirectly adjusts the output value from the second integration circuit.

43. The drive apparatus according to claim 42, wherein the first delay circuit inputs an output of the first adjusting circuit.

44. The drive apparatus according to claim 43, wherein the second delay circuit inputs an output of the second adjusting circuit.

45. The drive apparatus according to claim 42, wherein the third delay circuit inputs the output of the third adding circuit.

46. The drive apparatus according to claim 45, wherein the fourth delay circuit inputs the output of the fourth adding circuit.

47. The drive apparatus according to claim 42, wherein the third delay circuit inputs an output of the first adjusting circuit.

48. The drive apparatus according to claim 47, wherein the fourth delay circuit inputs an output of the second adjusting circuit.

49. The drive apparatus according to claim 30, wherein the modulating circuit comprises:

a first integration circuit that processes the first brightness value for the first portion of the display, wherein the first integration circuit comprises a first adding circuit and a first delay circuit that at least indirectly delays an output of the first adding circuit;

a second integration circuit that processes the second brightness value for the second portion of the display, wherein the second integration circuit comprises a second adding circuit and a second delay circuit that at least indirectly delays an output of the second adding circuit;

a third integration circuit that comprises a third adding circuit connected to the first integration circuit and a third delay circuit that at least indirectly delays an output of the third adding circuit;

a fourth integration circuit that comprises a fourth adding circuit connected to the second integration circuit and a fourth delay circuit that at least indirectly delays an output of the second adding circuit;

a detection circuit that detects a phase different between the first series of the output pulses and the second series of the output pulses based on the output of the third adding circuit and the output of the fourth adding circuit; and an adjusting circuit that at least indirectly adjusts at least one of an output value from the third integration circuit and an output value from the fourth integration circuit based on the phase difference.

50. The drive apparatus according to claim 49, wherein the adjusting circuit comprises:

a first adjusting circuit that at least indirectly adjusts the output value from the third integration circuit; and a second adjusting circuit that at least indirectly adjusts the output value from the fourth integration circuit.

51. The drive apparatus according to claim 50, wherein the third delay circuit inputs the output of the third adding circuit.

52. The drive apparatus according to claim 51, wherein the fourth delay circuit inputs the output of the fourth adding circuit.

53. The drive apparatus according to claim 50, wherein the third delay circuit inputs an output of the first adjusting circuit.

54. The drive apparatus according to claim 53, wherein the fourth delay circuit inputs an output of the second adjusting circuit.

* * * * *